US005558515A

United States Patent [19]

Althaus et al.

[11] Patent Number: 5,558,515

[45] Date of Patent: Sep. 24, 1996

[54] PREMIXING BURNER

[75] Inventors: Rolf Althaus, Kobe, Japan; Jakob Keller, Redmond, Wash.

[73] Assignee: ABB Management AG, Baden, Switzerland

[21] Appl. No.: 399,143

[22] Filed: Mar. 6, 1995

[30] Foreign Application Priority Data

Apr. 2, 1994 [DE] Germany ..... 44 11 622.5

[51] Int. Cl.[6] ..... F23Q 9/00

[52] U.S. Cl. ..... 431/284; 431/278; 431/353; 431/181

[58] Field of Search ..... 431/284, 278, 431/350, 351, 352, 183, 181

[56] References Cited

U.S. PATENT DOCUMENTS

| | | | |
|---|---|---|---|
| 5,094,610 | 3/1992 | Mandai et al. | 431/183 |
| 5,127,821 | 7/1992 | Keller | 431/350 X |
| 5,340,306 | 8/1994 | Keller et al. | 431/351 |
| 5,433,596 | 7/1995 | Döbbeling et al. | 431/350 |

FOREIGN PATENT DOCUMENTS

| | | |
|---|---|---|
| 0321809 | 6/1989 | European Pat. Off. . |
| 2-21118 | 1/1990 | Japan . |

*Primary Examiner*—Larry Jones
*Attorney, Agent, or Firm*—Burns, Doane, Swecker & Mathis

[57] ABSTRACT

A premixing burner includes a pilot burner formed from two half conical shells and a plurality of main burners arranged around the pilot burner. Each of the main burners is formed with an cylindrical outer wall to contain a main flow. Each of the main burners includes a plurality of vortex generators arranged inside the cylindrical wall about a circumference. In addition, a venturi nozzle is disposed in each of the main burners downstream of the vortex generators. A fuel lance for each of the main burners injects one or both of a gaseous and liquid fuel into the burner as a secondary flow, and an outlet of the lance is positioned to inject the secondary flow in the region of the venturi nozzle having a maximum constriction.

11 Claims, 3 Drawing Sheets

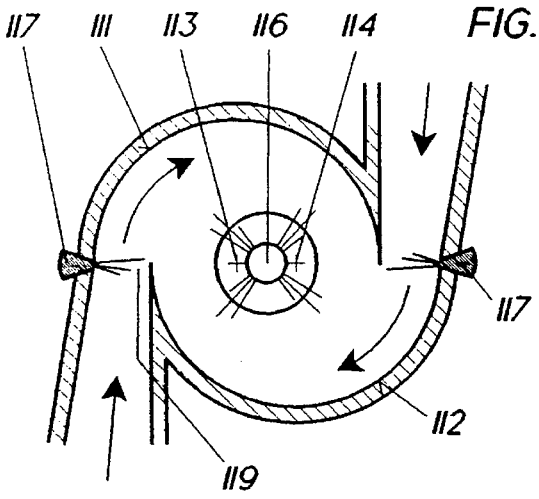
FIG. 3A
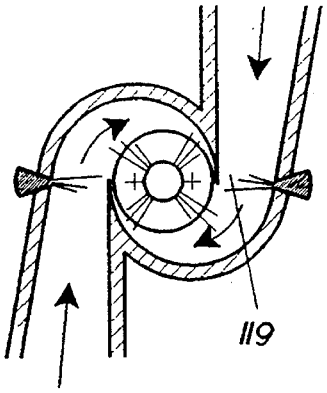
FIG. 3B
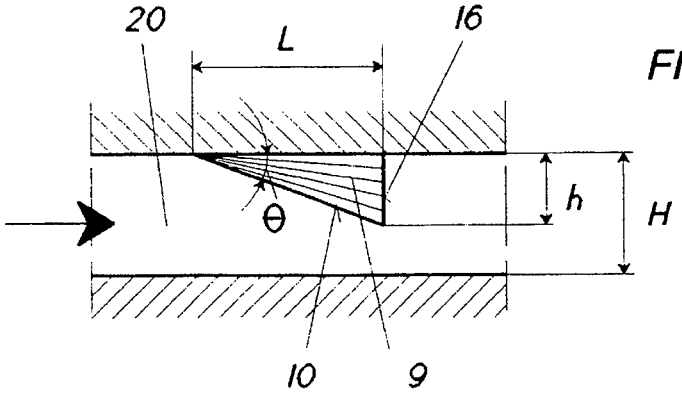
FIG. 7
FIG. 8
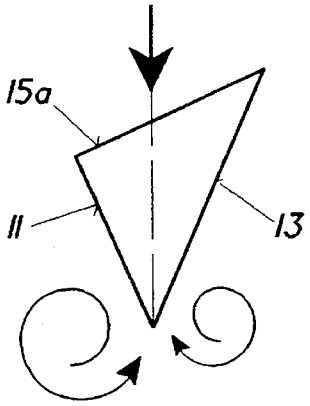
FIG. 9
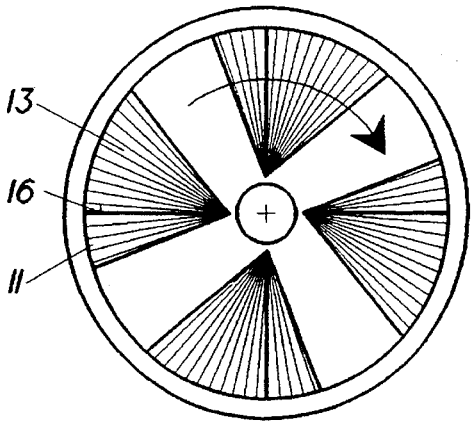

PREMIXING BURNER

BACKGROUND OF THE INVENTION

1. Field of the Invention

The invention relates to a premixing burner, essentially comprising a pilot burner and a plurality of main burners arranged around the pilot burner.

2. Discussion of Background

Both in oil operation at very high pressure and in gas operation using gases containing a large amount of hydrogen, the ignition delay times in the case of premixing burners can be so short that flame-holding burners can no longer be used as so-called low-$NO_x$ burners.

The admixture of fuel to a combustion-air flow flowing in a premixing duct is generally performed by radial injection of the fuel into the duct by means of cross-jet mixers. However, the momentum of the fuel is so low that virtually complete mixing is achieved only after a distance of about 100 duct heights. Venturi mixers are also employed. The injection of the fuel via lattice arrangements is also known. Finally, injection ahead of special swirl-inducing bodies is also employed.

The devices operating on the basis of cross jets or laminar flows either result in very long mixing sections or require high injection momentums. In the case of premixing at high pressure and under substoichiometric mixing conditions, there is the risk of flashback of the flame or even self-ignition of the mixture. Flow separations and stagnation zones in the premixing tube, thick boundary layers on the walls or, in some cases, extreme velocity profiles across the cross section through which flow takes place can cause self-ignition in the tube or form paths by which the flame can flash back into the premixing tube from the combustion zone located downstream. Maximum attention must therefore be paid to the geometry of the premixing section.

The so-called premixing burners of the double-cone type may be referred to as flame-holding burners. Double-cone burners of this kind are known, for example, from U.S. Pat. No. 5,193,995 to Keller et al. and are described later with reference to FIGS. 1 and 3. The fuel, in that case natural gas, is injected in the inlet gaps into the combustion air flowing in from the compressor, via a row of injector nozzles. Generally speaking, these are distributed uniformly over the entire gap.

In order to achieve reliable ignition of the mixture in the downstream combustion chamber and sufficient burn-up, thorough mixing of the fuel with the air is required. Good mixing also contributes to the avoidance of so-called "hot spots" in the combustion chamber, these leading, inter alia, to the formation of the undesirable $NO_x$.

The abovementioned injection of the fuel by conventional means such as, for example, cross-jet mixers is difficult since the fuel itself has an insufficient momentum to achieve the necessary large-scale distribution and fine-scale mixing.

SUMMARY OF THE INVENTION

Accordingly, one object of the invention is to provide a novel measure in a premixing burner of the type mentioned at the outset by means of which thorough mixing of the combustion air and the fuel is achieved within the shortest possible distance with, at the same time, an even velocity distribution in the mixing zone. The intention is, furthermore, reliably to prevent flashback of the flame in such a burner without using a mechanical flame holder. In addition, the measure is to be suitable for the retrofitting of existing premix combustion chambers.

According to the invention, this is achieved by virtue of the fact that

- a gaseous and/or liquid fuel is injected into the main burner, which has a circular duct, as a secondary flow into a gaseous main flow,
- that the main flow is first of all guided over vortex generators, a plurality of which are arranged next to one another around the circumference of the duct through which flow takes place,
- that a venturi nozzle is arranged downstream of the vortex generators,
- and that the secondary flow is introduced into the duct in the region of maximum constriction of the venturi nozzle.

Using the novel static mixer which the three-dimensional vortex generators represent, it is possible to achieve extremely short mixing distances in the burner and, at the same time, a low pressure loss. By virtue of the generation of longitudinal vortices without a recirculation zone, rough mixing of the two flows is complete after just one full vortex rotation, while fine mixing due to turbulent flow and molecular diffusion processes is present after a distance which corresponds to just a few duct heights.

This type of mixing is particularly suitable for mixing the fuel at a relatively low upstream pressure and with great dilution into the combustion air. A low upstream pressure of the fuel is advantageous particularly when fuel gases of medium and low calorific value are used. The energy required for mixing is in large part taken from the flow energy of the fluid with the higher volume flow, namely the combustion air.

The downstream arrangement of a venturi nozzle behind the vortex generators has the advantage that the maximum constriction of the venturi nozzle provides a simple means for introducing the fuel at the lowest possible back pressure into the swirled flow. Given correct dimensioning, the venturi nozzle furthermore has the advantage that the speed of flow therein exceeds the flame speed, making it impossible for the flame to flash back into the plane of injection of the fuel.

The vortex generators upstream of the venturi nozzle are distinguished by a top surface and two side surfaces, the side surfaces abutting the same duct wall and enclosing between them a V-angle $\alpha$, and the longitudinally directed edges of the top surface abutting the longitudinally directed side surface edges, which protrude into the flow duct, and extending at an angle of incidence $\theta$ to the duct wall.

The advantage of such vortex generators is to be seen in their particular simplicity in every respect. From a manufacturing point of view, the element consisting of three walls around which flow takes place is completely unproblematic. The top surface can be joined to the two side surfaces in various ways. The fixing of the element on flat or curved duct walls can moreover take place by means of simple welds in the case of weldable materials. From the point of view of fluid mechanics, the element exhibits a very low pressure loss when flow takes place around it and it generates vortices without a stagnation zone. Finally, the element can be cooled in many different ways and with various means because its internal space is in general hollow.

It is expedient for the ratio between the height h of the connecting edge of the two side surfaces and the duct height H to be selected in such a way that the vortex generated fills the complete duct height, or the complete height of the duct part assigned to the vortex generator, directly downstream of the vortex generator.

It is useful if the two side surfaces enclosing the V-angle α are arranged symmetrically about an axis of symmetry. This produces vortices having an equal swirl.

If the two side surfaces enclosing the V-angle α form an at least approximately sharp connecting edge with one another which, together with the longitudinal edges of the top surface, forms a point, the cross section of flow is virtually unimpeded.

If the sharp connecting edge is the outlet edge of the vortex generator and if it extends perpendicular to the duct wall on which the side surfaces abut, the non-formation of a wake region is of advantage.

If the axis of symmetry extends parallel to the duct axis and the connecting edge of the two side surfaces forms the downstream edge of the vortex generator while, as a consequence, that edge of the top surface which extends transversely to the duct through which flow takes place is the edge which the duct flow meets first, two equal but opposite vortices are generated at one vortex generator. A neutral-swirl flow pattern is present in which the direction of rotation of the two vortices rises in the region of the connecting edge.

Further advantages of the invention, particularly in connection with the arrangement of the vortex generators and the introduction of the fuel, emerge from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3A shows a cross section through a premixing burner of the double-cone type in the region of its outlet;

FIG. 3B shows a cross section through the same premixing burner in the region of the cone apex;

FIG. 7 shows a vortex generator in a duct;

FIG. 8 shows a further variant embodiment of the vortex generator;

FIG. 9 shows a variant arrangement of the vortex generator shown in FIG. 8.

DESCRIPTION OF THE PREFERRED EMBODIMENTS

Figure 1:
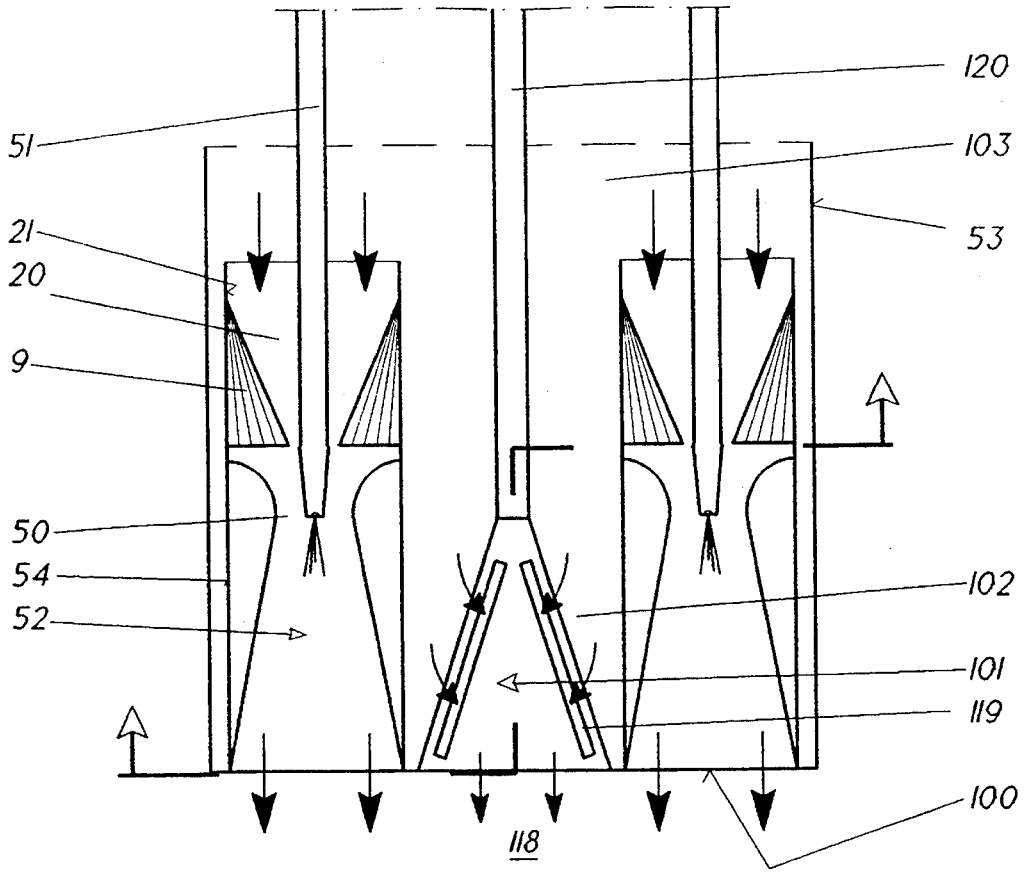
FIG. 1 shows a partial longitudinal section of a burner.
Figure 2:
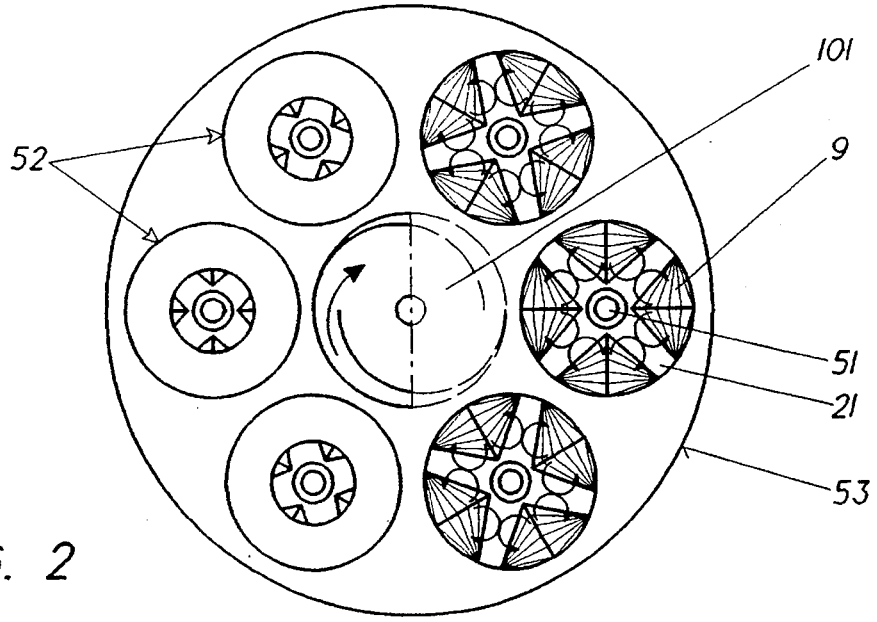
FIG. 2 shows a cross section through the burner

Referring now to the drawings, wherein like reference numerals designate identical or corresponding parts throughout the several views, where only the elements essential for the understanding of the invention are shown (elements inessential to the invention such as casing, fastenings, conduit lead-throughs, the preparation of the fuel, the control devices and the like being omitted) and the flow direction of the working media is indicated by arrows, in FIGS. 1 and 2, 53 designates a cylindrical burner wall. At its outlet end, it is connected by suitable means to the front wall 100 of the combustion chamber (not shown). This combustion chamber can be either an annular combustion chamber or a silo combustion chamber and, in each case, a plurality of such burners are arranged on the front wall 100.

Inside the burner wall, the inlet end of which is shown in broken lines in FIG. 1, six main burners 52 are grouped around a centrally arranged pilot burner 101. In the example, the pilot burner is a premixing burner of the double-cone type, although this is not compulsory. The essential factor is that this pilot burner should have as small a geometry as possible. About 10–30% of the fuel should be burnt in it. The main burners 52 are cylindrical in shape. Arranged on the tubular wall 54 of the latter there are first of all in the direction of flow vortex generators 9, the outlet of which opens into a venturi nozzle 50. The fuel is fed to the pilot burner and the main burners via fuel lances 120 and 51 respectively. The combustion air passes into the casing interior 103 from a plenum (not shown) and, from the casing interior, flows into the burners 101, 52 in the direction of the arrows.

The schematically represented premixing burner 101 shown in FIGS. 1, 3A and 3B is a so-called double-cone burner as known, for example, from U.S. Pat. No. 5,193,995 to Keller et al. It consists essentially of two hollow conical partial bodies 111, 112 which are interleaved in the direction of flow. The respective center lines 113, 114 of the two partial bodies are offset relative to one another. The adjacent walls of the two partial bodies form along their length tangential gaps 119 for the combustion air, which in this way reaches the inside of the burner. Arranged there is a first fuel nozzle 116 for liquid fuel. The fuel is injected into the hollow cone at an acute angle. The conical fuel profile which arises is enclosed by the tangentially entering combustion air. The concentration of the fuel is continuously reduced in the axial direction because of the mixing with the combustion air. In the example, the burner is likewise operated with gaseous fuel. For this purpose, gas inlet openings 117 distributed in the longitudinal direction are provided in the walls of the two partial bodies in the region of the tangential gaps 119. In gas operation, mixture formation with the combustion air has thus already commenced in the zone of the inlet gaps 20. It is obvious that mixed operation with both types of fuel is also possible in this way.

A fuel concentration which is as homogeneous as possible over the annular cross section to which the mixture is admitted is established at the burner outlet 118. A defined cap-shaped reverse flow zone is formed at the burner outlet and ignition takes place at the apex of this zone. To this extent, double-cone burners are known from U.S. Pat. No. 5,193,995 to Keller et al. mentioned at the beginning.

Before detailing the installation of the new mixing device in the main burners 52, a description will first of all be given of the vortex generator 9 essential for the manner in which the invention operates.

Figure 4:
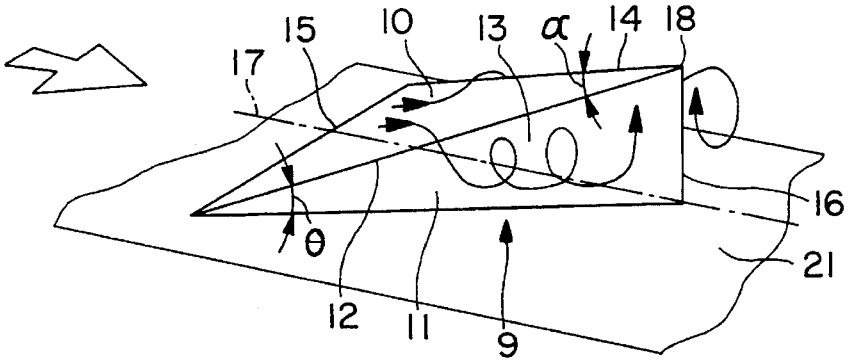
FIG. 4 shows a perspective representation of a vortex generator.
Figure 5:
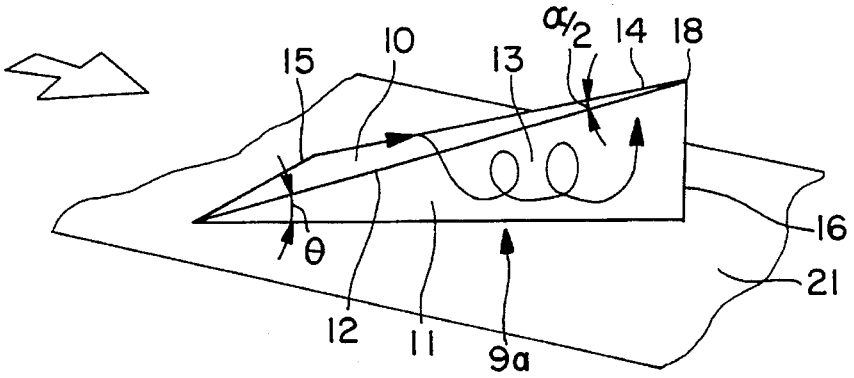
FIG. 5 shows a variant embodiment of the vortex generator.
Figure 6:
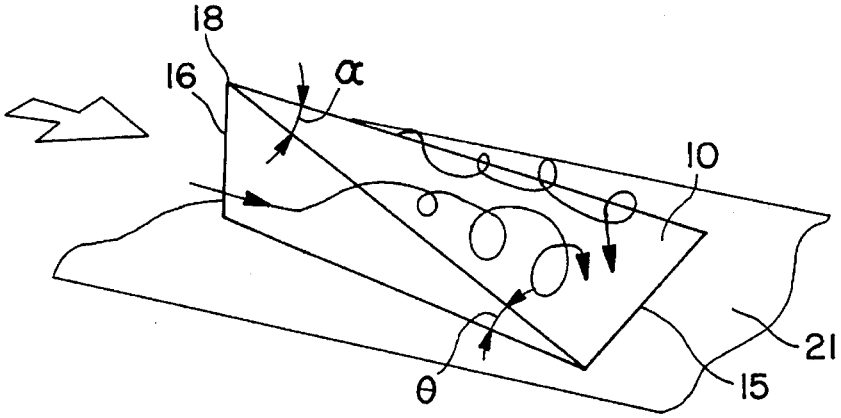
FIG. 6 shows a variant arrangement of the vortex generator shown in FIG. 4.

The actual duct through which flows a main flow symbolized by a large arrow is not shown in FIGS. 4, 5 and 6. According to these figures, a vortex generator consists essentially of three triangular surfaces around which flow can take place freely. These are a top surface 10 and two side surfaces 11 and 13. In their longitudinal direction, these surfaces extend at defined angles in the direction of flow.

The side walls of the vortex generator, which consist of right-angled triangles, are fixed by their longitudinal sides on a duct wall 21, preferably in a gastight manner. They are oriented in such a way that they form a joint at their narrow sides, enclosing a V-angle α. The joint is designed as a sharp connecting edge 16 and is perpendicular to the duct wall 21 on which the side surfaces abut. In FIG. 4, the two side surfaces 11, 13 enclosing the V-angle α are symmetrical in shape, size and orientation and are arranged on both sides of an axis of symmetry 17. This axis of symmetry 17 runs in the same direction as the duct axis.

The top surface 10 rests by an edge 15 of very narrow design running transversely to the duct through which flow takes place on the same duct wall 21 as the side walls 11, 13. Its longitudinally directed edges 12, 14 abut the longitudinally directed side surface edges protruding into the flow duct. The top surface extends at an angle of incidence θ to the duct wall 21. Its longitudinal edges 12, 14, together with the connecting edge 16, form a point 18.

The vortex generator can also, of course, be provided with a bottom surface by means of which it is fastened to the duct wall 21 in a suitable manner. Such a bottom surface, however, has no relationship to the mode of operation of the element.

In FIG. 4, the connecting edge 16 of the two side surfaces 11, 13 forms the downstream edge of the vortex generator. That edge 15 of the top surface 10 which extends transversely to the duct through which flow takes place is thus the edge which the duct flow meets first.

The mode of operation of the vortex generator is as follows: when flow occurs around the edges 12 and 14, the main flow is converted into a pair of opposing vortices. Their vortex axes are located in the axis of the main flow. The swirl number and the location of vortex breakdown, where the latter is desired at all, are determined by appropriate selection of the angle of incidence θ and of the V-angle α. With increasing angles, the vortex strength and the swirl number are increased and the location of vortex breakdown moves upstream into the region of the vortex generator itself. Depending on the application, these two angles θ and α are determined by design requirements and by the process itself. It is then only necessary to adapt the length L of the element and the height h of the connecting edge 16 (FIG. 7).

FIG. 5 shows a so-called "half vortex generator" based on a vortex generator in accordance with FIG. 1, where only one of the two side surfaces of the vortex generator 9*a* is provided with the V-angle α/2. The other side surface is straight and aligned in the direction of flow. In contrast to the symmetrical vortex generator, there is only one vortex in this case and it is generated on the angled side. In consequence, the field downstream of the vortex generator is not vortex-neutral; on the contrary, a swirl is imposed on the flow.

In FIG. 6, in contrast to FIG. 4, the sharp connecting edge 16 of the vortex generator 9 is the point which meets the duct flow first. The element is rotated by 180°. As can be seen from the representation, the two opposing vortices have changed their direction of rotation.

According to FIG. 7, the vortex generators are installed in a duct 20. The height h of the connecting edge 16 will, as a rule, be matched to the duct height H—or to the height of the duct part to which the vortex generator is assigned—in such a way that the vortex generated has already achieved such a size immediately downstream of the vortex generator that the complete duct height H is filled. This leads to a uniform velocity distribution in the cross section acted upon by the flow. A further criterion which can affect the ratio h/H to be chosen is the pressure drop which occurs when flow takes place around the vortex generator. It is obvious that as the ratio h/H increases, the pressure loss coefficient also increases.

In the example illustrated, four vortex generators 9 are, according to FIG. 2, distributed at intervals around the circumference of the circular cross section. The above-discussed height of the duct part to which the individual vortex generator is assigned corresponds in this case to the circle radius. Obviously, the four vortex generators 9 could also be arranged side by side in a circumferential direction on their respective wall segments 21 in such a way that no spaces are left at the duct wall. In the final analysis, the vortex to be generated is the decisive factor here.

The vortex generators 9 are used primarily for mixing two flows. The main flow in the form of combustion air approaches the transversely oriented inlet edges 15 in the direction of the arrow. The secondary flow in the form of a gaseous and/or liquid fuel has a considerably lower mass flow than the main flow. In the present case, it is introduced into the main flow downstream of the vortex generators.

According to FIG. 1, the fuel is here injected by means of a central fuel lance 51, the outlet of which is located downstream of the vortex generators. This lance is dimensioned for approximately 10% of the total volume flow through the duct 20. The figure shows longitudinal injection of the fuel in the direction of flow. In this case, the momentum of injection corresponds approximately to that of the momentum of the main flow. Cross-jet injection could equally well be provided, in which case the momentum of the fuel must then be about twice that of the main fuel.

The injected fuel is entrained by the vortices and mixed with the main flow. It follows the helical course of the vortices and is evenly and finely distributed downstream of the vortices in the chamber. This reduces the risk of impact streaks on the opposite wall and the formation of so-called "hot spots"—which exists with the radial injection of fuel into an unswirled flow, as mentioned at the beginning.

Since the main mixing process takes place in the vortices and is largely independent of the momentum with which the secondary flow is injected, the fuel injection can be kept flexible and matched to other boundary conditions. As an example, the same momentum of injection can be retained over the whole load range. Since the mixing is determined by the geometry of the vortex generators, and not by the machine load, in the example the gas turbine power, the burner configured in this way operates in an optimum fashion even under part-load conditions. The combustion process is optimized by matching the ignition delay time of the fuel and mixing time of the vortices; this ensures a minimization of emissions.

In addition, the intensive mixing produces a good temperature profile over the cross section through which flow takes place and furthermore reduces the possibility of the occurrence of thermoacoustic instability. Simply by their presence, the vortex generators act as a damping measure against thermoacoustic vibrations.

In order to avoid a flashback of the flame into the burner, a venturi nozzle 52 is provided downstream of the vortex generators. This is dimensioned in such a way that, at an exit velocity of about 80–150 m/s, the flow velocity in the narrowest cross section is about 150–180 m/s. The distance between the narrowest cross section and the outlet edges 16 of the vortex generators will be chosen in such a way that the vortices generated are already fully formed in the narrowest cross section. The location of the fuel injection is situated in the plane of maximum constriction of the venturi nozzle.

FIGS. 8 and 9 show a variant embodiment of the vortex generator in a plan view and, in a front view, its arrangement in a circular duct. The two side surfaces 11 and 13 enclosing the V-angle α are of different lengths. This means that the top surface 10 lies with an edge 15*a* extending obliquely to the duct through which flow takes place on the same duct wall as the side walls. Obviously, the vortex generator then has a differing angle of incidence θ across its width. Such a variant has the effect that vortices of different strength are generated. It is possible by this means, for example, to exert an influence on a swirl to which the main flow is subject. Or the differing vortices are used to impose a swirl on the originally swirl-free main flow downstream of the vortex generators, as indicated in FIG. 9. Such a configuration is well-suited to serve as an independent compact burner unit. When a plurality of such units are used, for example in an annular gas-turbine combustion chamber, the swirl imposed on the main flow can be utilized to improve the transverse ignition behavior of the burner configuration, for example at part load.

Obviously, numerous modifications and variations of the present invention are possible in light of the above teachings. It is therefore to be understood that within the scope of the appended claims, the invention may be practiced otherwise than as specifically described herein. With regard to the interconnection of the vortex generators, many different combinations are possible without exceeding the scope of the invention. The introduction of the secondary flow into the main flow too can be performed in numerous different ways, for example solely or additionally via wall holes in the venturi tube.

What is claimed as new and desired to be secured by Letters Patent of the United States is:

1. A premixing burner, comprising:

a premixing pilot burner;

a plurality of premixing main burners arranged around the pilot burner, each of the main burners having a circular flow duct for a main flow;

means for injecting at least one of a gaseous and a liquid fuel into each main burner as a secondary flow into the main flow, a plurality of vortex generators disposed in each main burner around a circumference in the duct for generating a plurality of vortices in the main flow; and a venturi nozzle arranged in the circular flow duct of each main burner downstream of the vortex generators;

wherein the secondary flow is injected into the duct of each main burner in a region of maximum constriction of the venturi nozzle.

2. The premixing burner as claimed in claim 1, wherein the pilot burner comprises two hollow conical partial bodies which are disposed to define a conical interior space extending longitudinally in a direction of flow, respective longitudinal center lines are offset relative to one another, wherein adjacent walls of the two partial bodies form in the longitudinal direction tangential ducts for a tangentially directed inflow of combustion air and having gas inlet openings disposed in the longitudinal direction in the walls of the two partial bodies in a region of the tangential gaps.

3. The premixing burner as claimed in claim 1, wherein each vortex generator comprises a body having three surfaces extending into the flow, which surfaces have a longitudinal direction extending in the direction of flow, one of said surfaces forming a top surface and the two others forming side surfaces wherein an edge of each of the side surfaces abuts a same wall segment of the duct and the side surfaces enclose an acute angle between them, wherein the top surface is positioned with an edge extending transversely to the flow direction and abutting on the same wall segment as the side walls, and wherein longitudinally directed edges of the top surface abut longitudinally directed side surface edges protruding into the flow duct, and the top surface is positioned at an angle of incidence to the wall segment.

4. The premixing burner as claimed in claim 3, wherein the two vortex generator side surfaces enclosing the acute angle are arranged symmetrically about an axis of symmetry.

5. The premixing burner as claimed in claim 3, wherein the two side surfaces enclosing the acute angle meet at a connecting edge which, together with the longitudinally directed edges of the top surface forms a point, and wherein the connecting edge is positioned radially with respect to the circular duct.

6. The premixing burner as claimed in claim 5, wherein at least one of the connecting edge and the abutting longitudinally directed edges of the top surface and side surfaces are designed to be at least approximately sharp.

7. The premixing burner as claimed in claim 5, wherein an axis of symmetry of each vortex generator extends parallel to a duct axis, the connecting edge of the two side surfaces is disposed as a downstream edge, and the edge of the top surface which extends transversely to the flow direction is disposed as an upstream edge.

8. The premixing burner as claimed in claim 1, wherein a ratio between a height of the vortex generator and a duct height is selected so that a vortex generated fills the duct height directly downstream of the vortex generator.

9. The premixing burner as claimed in claim 1, wherein said means for injecting the secondary flow is a fuel lance disposed centrally in the duct, and directed for longitudinal injection.

10. The premixing burner as claimed in claim 1, wherein a ratio between a height of the vortex generator and a duct height is selected so that a vortex generated fills a height of a duct part in which the vortex generator is disposed directly downstream of the vortex generator.

11. The premixing burner as claimed in claim 1, wherein said means for injecting the secondary flow is a fuel lance disposed centrally in the duct and directed for cross-jet injection.

* * * * *